US005160963A

United States Patent [19]

Haneda et al.

[11] Patent Number: 5,160,963

[45] Date of Patent: Nov. 3, 1992

[54] IMAGE FORMING APPARATUS HAVING PROCESS CARTRIDGE

[75] Inventors: Satoshi Haneda; Shizuo Morita; Masakazu Fukuchi; Shunji Matsuo, all of Hachioji, Japan

[73] Assignee: Konica Corporation, Tokyo, Japan

[21] Appl. No.: 634,068

[22] Filed: Dec. 26, 1990

[30] Foreign Application Priority Data

Jan. 11, 1990 [JP] Japan ..... 2-4300
Jan. 12, 1990 [JP] Japan ..... 2-5800
Jan. 12, 1990 [JP] Japan ..... 2-5801

[51] Int. Cl.[5] ..... G03G 15/00
[52] U.S. Cl. ..... 355/200; 355/260
[58] Field of Search ..... 355/200, 210, 211, 245, 355/260

[56] References Cited

U.S. PATENT DOCUMENTS 4,627,701 12/1986 Onoda et al. ..... 355/221
4,803,510 2/1989 Maeda ..... 355/210
4,806,970 2/1989 Nakatomi ..... 355/282
4,952,974 8/1990 Mori ..... 355/200
4,974,020 11/1990 Takamatsu et al. ..... 355/245 X
4,985,731 1/1991 Sakakura et al. ..... 355/210

FOREIGN PATENT DOCUMENTS 240168 10/1987 European Pat. Off. .
314140 5/1989 European Pat. Off. .
0140264 12/1985 Japan .
0210965 8/1989 Japan .
0315770 12/1989 Japan ..... 355/260
2199537 7/1988 United Kingdom .

OTHER PUBLICATIONS

Makoto et al., European Patent Application #345,089, Dec. 1989.

*Primary Examiner*—A. T. Grimley
*Assistant Examiner*—Robert Beatty
*Attorney, Agent, or Firm*—Jordan B. Bierman

[57] ABSTRACT

The invention provides an apparatus for forming image, components of which are classified into two groups. A first group includes a photoreceptor on which an electrostatic latent image is formed, a charger for charging the photoreceptor, and a developing device for developing the latent image into a toner image; and a second group includes a transferring device for transferring the toner image to a recording sheet, a sheet passage for passing the recording sheet through the transferring device, and a toner container for storing toner. In the above constitution, the second group is arranged to dispose above the first group.

4 Claims, 9 Drawing Sheets

IMAGE FORMING APPARATUS HAVING PROCESS CARTRIDGE

BACKGROUND OF THE INVENTION

The present invention relates to a process cartridge (hereinafter called cartridge) of an image forming apparatus.

In an image forming apparatus, a cartridge which comprises integrated components such as a charging unit, a developing unit, a toner box, and a cleaning unit when necessary are installed around an image forming unit and can be installed in or removed from the image forming apparatus is often recently used.

FIGS. 8 and 9 show configuration examples. In FIG. 8, numeral 100 indicates a cartridge, and four components of an image forming drum 1, a charging unit 2, a developing unit 3, and a cleaner 4 are integrated. The cartridge can be installed in or removed from an image forming apparatus which is not shown in the figure, and the four units are relatively positioned and assembled in a housing 10 as specified.

Numeral 5 indicates a protective cover with a circular section for opening or closing an exposure opening 11 at the bottom of the image forming drum 1 which is installed at the bottom of the housing 10. A moving arm 13 which can freely rotate round a supporting point 12 installed on the side plate of the housing 10 is installed, the back end of the protective cover 5 is joined to and supported by a free end 14 of the arm 13 so that the back end can rotate freely, and a pin shaft 15 at the front end of the protective cover 5 is joined to and supported by a circular guide slot 16 of the side plate of the housing 10.

When the moving arm 13 rotates counterclockwise, the protective cover 5 moves to right and the exposure opening 11 at the bottom of the image forming unit (hereinafter called just the exposure opening) is opened. When the moving arm 13 moves clockwise, the exposure opening 11 is closed.

The protective cover 5 is used to prevent the image forming unit from being exposed to outside light through the exposure opening 11 when the cartridge 100 is removed from the image forming apparatus or to keep the image forming unit away from dust or damage due to contact with another object. The protective cover 5 may be designed so that it can be opened or closed manually or it is automatically opened or closed by a pin, spring, or cam when it is removed or installed.

Numeral 6 indicates a slit window for image exposure and 7 a shutter for opening or closing the window 6. The function of the shutter is the same as that of the protective cover 5.

When the cartridge 100 is installed in the image forming apparatus, the protective cover 5 and the shutter 7 are open. The surface of the image forming drum 1 exposed through the exposure opening 11 is opposite to a transfer unit 8 installed in the image forming apparatus.

When the pushbutton is pressed, the image forming drum 1 and a developing sleeve **3*a* start rotation in the directions of the arrows at a predetermined rotation speed and each unit is applied with a predetermined voltage. The image forming drum 1 is uniformly charged by the charging unit 2, and exposed to image exposure light L from an image exposure unit of the main unit of the image forming apparatus via the window 6. By doing this, an electrostatic latent image is formed on the image forming drum 1. The electrostatic latent image is subject to toner development by a developing unit 3*b* and transferred onto a recording paper P fed via the feed path from the feed unit of the main unit of the image forming apparatus by the transfer unit 8**.

The recording paper with the toner image transferred on is separated from the surface of the image forming drum 1, fed to a fixing unit of the main unit of the image forming apparatus, fixed there, and ejected from the apparatus. The portion of the image forming drum 1 where the image transfer is finished is cleaned by scraping off residual toner with a cleaning blade **4*a* of the cleaner 4, charged by the charging unit 2** once again, and subject to the next image forming.

A developing unit 3 comprises a developing unit **3*b* and a toner box 3*c*. A developing sleeve 3*a* is installed in the developing unit 3*b*, and toner t is contained in the toner box 3*c*. The toner t in the toner box 3*c* is fed to the developing unit 3*b* via a through hole 3*d*** to be used for development.

FIG. 9 is a drawing of another cartridge which is installed in a copier.

Numeral 17 indicates a document tray made of glass, which moves back and forth in the direction of the arrow during copy. The image on a document placed on the document tray 17 is irradiated with light from a document illuminating lamp 18 and rotated by a convergent light transmitter (trade name Selphox lens) 19 in the direction of the arrow in synchronization with the movement of the document. A latent image is formed on the image forming drum 1 with the entire surface charged by the charging unit 2 beforehand.

The electrostatic latent image is developed by the developing unit **3*b*. The recording paper P is fed by a paper feed roller 20 one by one, comes in contact with the image forming drum 1 via register rollers 21, transferred with the image on the image forming unit by the transfer unit 8, separated from the image forming drum 1 by a separation electrode 22, moves forward along a guide plate 23, and ejected outside the apparatus via fixing rollers 24 and paper ejection rollers 25. After image transfer, the surface of the image forming unit is eliminated residual charge by a discharging electrode 26 and removed residual toner by the cleaner 4, and then charged by the charging unit 2 once again to start the next image forming process. In this copier, the image forming charging unit 2, the developing unit 3, the transfer unit 8, the separation electrode 22, the discharging electrode 26, the cleaner 4, the illuminating lamp 18, and the guide plates 27, 28, and 29 are integrated to a cartridge 30 (indicated by an alternate long and short dash line), which is mounted so that it can be installed or removed by sliding on supporting rails 31 and 32 installed on the main unit. The cartridge 30** is locked at a predetermined location by a locking means, which is not shown in the figure, when it is used.

However, the following problems are imposed by the conventional cartridge configuration mentioned above.

The first problem, which is common to the cartridge configurations in FIGS. 8 and 9, is that the major components incorporated in the cartridge are installed around the image forming drum 1 only above the feed path for the recording paper P; that is, the charging unit 2, the developing unit **3*b*, the toner box 3*c*, and the cleaner 4 are concentrated around the image forming drum 1 only above the feed path for the recording paper P. Only the transfer unit 8** (the separation electrode in FIG. 9 is included) is under the paper feed path. For that reason, the dimensions of each unit are restricted. Although the dimensions may be changed, to increase the storage amount of toner, it is necessary to increase the capacity of the toner box or to make the toner box wider in consideration of a well-balanced shape.

The second problem is that since the recording paper feed path is under the image forming drum 1, the toner image on the image forming drum 1 is transferred onto the upper surface of the recording paper P. If the transferred image is fixed by the fixing rollers and the recorded paper is ejected as it is, the image surface is up. When a plurality of pages are printed by a printer sequentially starting at the first page, the pages are stacked in the reverse sequence with the first page at the bottom. If this occurs, it is necessary to rearrange the pages and it requires a great deal of time. To avoid it, it is necessary to turn over the recording paper once after fixing.

The third problem is that the transfer unit 8 and the guide plates 27 and 28 in FIG. 8 remain in the main unit of the apparatus, requiring a great deal of time for maintenance and inspection.

The fourth problem is that since the recording paper feed path in FIG. 9 cannot be revealed, it is rather difficult to clean the paper feed path or to remove jammed paper.

SUMMARY OF THE INVENTION

In consideration of those problems on the prior art, the first object of the present invention is to provide an image forming apparatus suited to an optical printer having a laser or LED image exposure unit wherein the recording paper feed path is installed above the image forming unit and the toner box is installed above the paper feed path, so that the capacity of the toner box can be increased by increasing the vertical dimension of the toner box and pages can be arranged without turning over because the transfer surface of the recording paper is down. The second object of the present invention is to provide an image forming apparatus which is structured so that the recording paper feed path can be revealed and the toner box and transfer unit can be installed or removed.

The present invention comprises the following means configurations to accomplish the above objects.

The first configuration of an image forming apparatus of the present invention is that the recording paper feed path, transfer means, and toner box are installed above the image forming drum, the charging means, developing unit, and cleaner are installed around the image forming unit under the paper feed path, and the image forming unit and the other components are integrated to a process cartridge which can be installed in or removed from the apparatus.

The above cleaner can be omitted by using a developing unit which performs developing and cleaning simultaneously by a magnetic brush.

The second configuration is that the process cartridge in the above configuration is structured so that the recording paper feed path can be revealed by holding up the one side of the toner box and transfer means in the integrated state.

The third configuration is that in the first or second configuration, the toner box and/or the transfer means can be installed in or removed from the process cartridge.

As a charging means, a non-contact charging means by corona discharge by a charging unit or a contact charging means using a brush or roller applied with a bias voltage may be used. A transfer means using a charging unit by corona discharge or using a bias roller may be used. Next, the function of an image forming apparatus of the present invention having the above means configurations will be described hereunder. In a conventional apparatus, the charging means, developing unit, toner box, cleaner, etc., except the transfer means (the separation electrode is included) are all installed around the image forming drum on one side of the recording paper feed path. In the present invention, the paper feed path is installed above the image forming drum, and the transfer means and toner box are installed above the paper feed path. Accordingly, to increase the capacity of the toner box, the box can be extended upward without being widened. The cartridge can be exchanged or maintained easily. Since the transfer is performed on the upper surface of the image forming unit, toner images are transferred onto the lower surface of the recording paper and fixed as they are. When sheets are ejected and stacked, they are arranged starting at the first page.

In the second configuration, when the toner box and transfer means are pivoted upward, the paper feed path is revealed and jammed paper can be easily removed. In the third configuration, only the toner box or the transfer means can be easily removed and exchanged from the cartridge.

DETAILED DESCRIPTION OF THE PREFERRED EMBODIMENT

Next, embodiments of an image forming apparatus of the present invention will be described hereunder with reference to the accompanying drawings.

Figure 1:
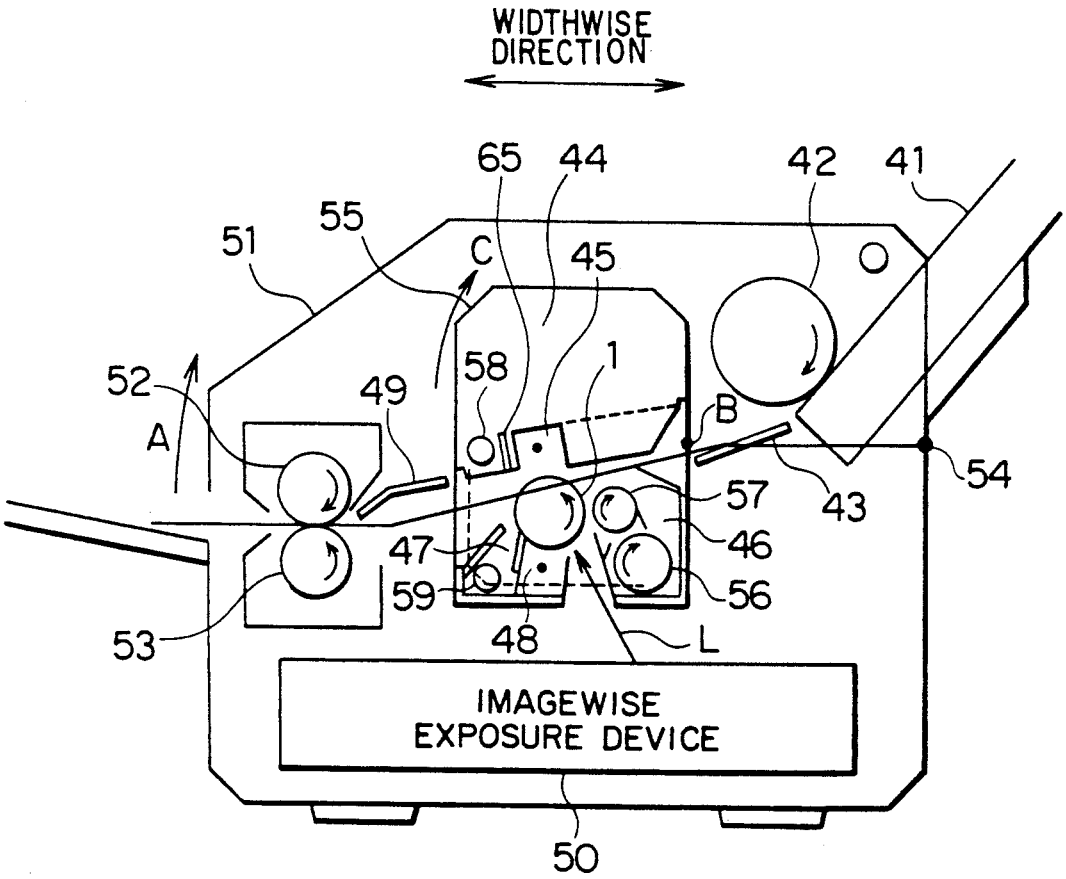
FIG. 1 is a schematic view of an embodiment of an image forming apparatus of the present invention.
Figure 2:
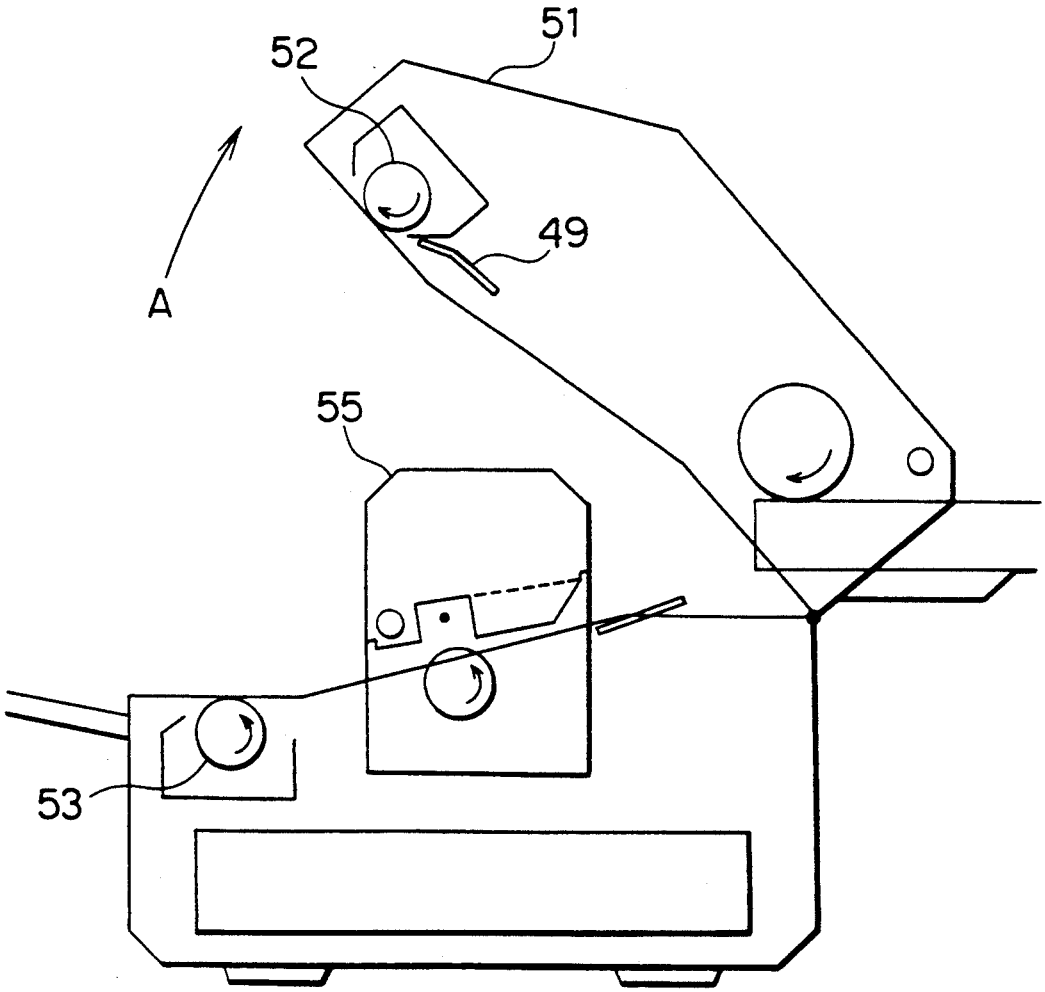
FIG. 2 is a drawing showing the status of the apparatus shown in FIG. 1 when the upper cover is pivoted upward.

FIG. 1 is a schematic view of an embodiment of an image forming apparatus of the present invention. In the figure, numeral 55 indicates a cartridge which is installed in the image forming apparatus. A recording paper moves on a guide plate 43 from a paper feed cassette 41 by a paper feed roller into the cartridge 55. When the recording paper passes between an image forming unit 1 and a transfer unit 45 and discharging bar 65, the toner image is transferred onto the recording paper and enters between an upper fixing roller 52 and a lower fixing roller 53 via a guide plate 49 to be fixed. The fixed paper is then ejected from the apparatus.

The path through which the recording paper passes is a paper feed path. In the present invention, the transfer unit 45, the discharging bar 65, and a toner box 44 are installed above this paper feed path. A cleaner 47, a charging unit 48, and a developing unit 46 are installed under the paper feed path.

Toner is fed from the toner box 44 via the cleaner 47 to the developing unit 46. The path is indicated by a dotted line in the figure. The toner box 44 is provided with a screw 58 and the cleaner 47 is provided with a screw 59. Toner moves in the depth direction of the drawing, and is fed by a flexible screw pipe (not shown in the figure) installed on the back or front side. Toner which is put into the developing unit 46 is stirred with a carrier by a stirrer 56 and coated on the developing sleeve 57 as a thin layer, and the electrostatic latent image on the image forming unit 1 is reversely developed by the magnetic brush.

An upper cover 51 of the image forming apparatus is divided by the alternate long and short dash line and joined by a hinge 54 so that it can rotate freely. Accordingly, the upper cover 51 can be opened in the direction of the arrow A. Since the upper fixing roller 52 is mounted to the upper cover 51, it is pivoted upward together with the upper cover 51. This configuration allows jammed paper in the fixing unit to be easily removed and the cartridge 55 to be installed or removed from the top of the apparatus.

In this case, the upper fixing roller 52 and the lower fixing roller 53 are revealed. Therefore, it is desirable to provide a protective cover for the upper fixing roller 52 which is opened or closed together with the upper cover 51 and the lower fixing roller 53. In the image forming apparatus of the present invention, the recording paper feed path is installed above the image forming unit and the toner box is installed above the paper feed path. Therefore, the capacity of the toner box can be increased by increasing the height thereof without increasing the width thereof. Toner can be supplied easily into the toner box or the toner box can be easily exchanged from the top of the apparatus. Since the transfer surface of each recording paper is down, papers can be fixed, ejected, and stacked as they are, and pages are arranged starting at the first page.

Figure 3:
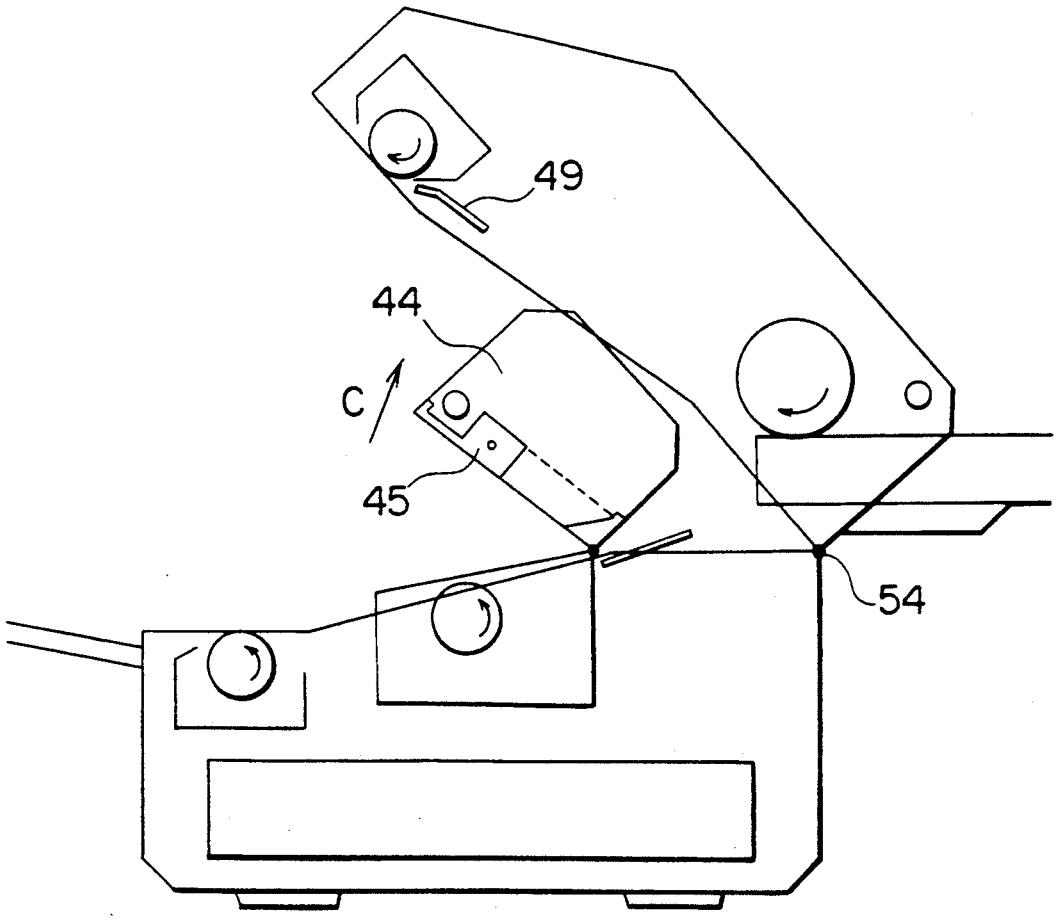
FIG. 3 is a drawing showing the status of the apparatus shown in FIG. 1 when the upper cover and the toner box and transfer unit of the cartridge are pivoted upward.

Since the cartridge 55 used in the present invention is relatively narrow, jammed paper can be easily removed from the cartridge. To allow jammed paper to be removed from the cartridge more easily, the toner box 44 and the transfer unit 45 can be pivoted upward in the direction of the arrow C in an integrated state as shown in FIG. 3 using the point B shown in FIG. 1 as a supporting point. By doing this, the recording paper feed path is revealed and jammed paper can be easily removed.

The toner box 44 and the transfer unit 45 may be pivoted upward in the direction of the arrow C in synchronization with the upper cover 51 which is pivoted upward in the direction of the arrow A. It is desirable for protection of the image forming drum 1, however, that the toner box 44 and the transfer unit 45 can be pivoted upward manually when necessary. When the cartridge is structured so that the toner box 44 and the transfer unit 45 can be installed in or removed from the frame of the cartridge though they cannot be pivoted upward, it is convenient because the toner box or the transfer unit can be simply exchanged during field maintenance. In the present invention, the upper fixing roller 52 is opened simultaneously with the upper cover 51 which is opened. However, the upper fixing roller 52 may be left on the lower frame side. In this case, it is desirable to release the fixing rollers from contact when the upper cover 51 is opened.

As mentioned above, the image forming apparatus of the present invention comprises a cartridge wherein the recording paper feed path, transfer unit, and toner box are installed above the image forming unit, and the charging means and developing unit are installed around the image forming unit under the paper feed path, and those units can be installed in or removed from the cartridge in an integrated state. Therefore, the capacity of the toner box can be increased by increasing the vertical dimension of the toner box without increasing the width thereof, and pages can be arranged without a turning facility because the transfer surface of the recording paper is down.

In the second configuration, the toner box and the transfer unit can be pivoted upward in an integrated state, and the recording paper feed path can be revealed. Therefore, jammed paper can be easily removed.

In the third configuration, the toner box and the transfer means can be exchanged. It is convenient for maintenance.

Another embodiment for opening the recording paper feed path will be described hereunder.

In this embodiment, the apparatus frame comprises a lower frame and an upper frame, and the upper frame can rotate round the horizontal shaft which joins and supports the two frames for opening or closing. The first unit containing the image forming drum and the cleaner, charging means, and developing unit which are installed around the image forming drum is mounted to the lower frame. The second unit containing the toner box and transfer means is mounted to the upper frame. When the upper frame is closed against the lower frame, the image forming drum is opposite to the transfer means to form a recording paper feed path.

In the above configuration, the first unit can be installed in or removed from the lower frame, and the second unit can be installed in or removed from the upper frame.

Next, this embodiment will be described hereunder with reference to the drawings.

Figure 4:
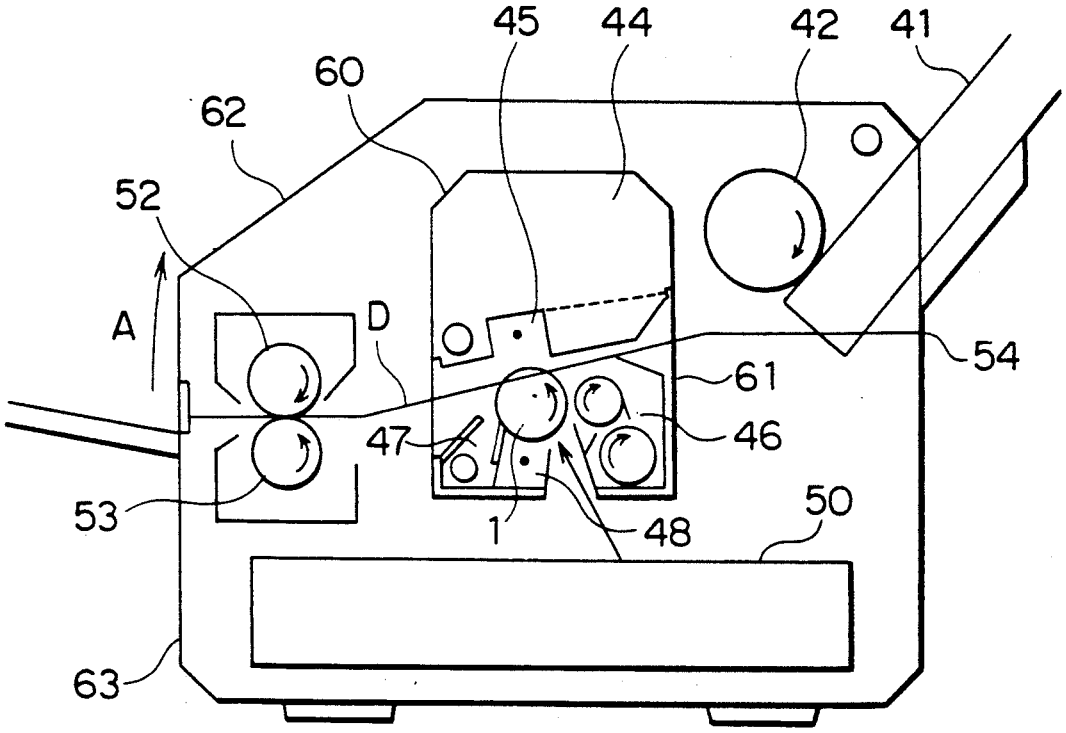
FIG. 4 is a schematic view of another embodiment for releasing the recording paper feed path with the upper frame closed.
Figure 5:
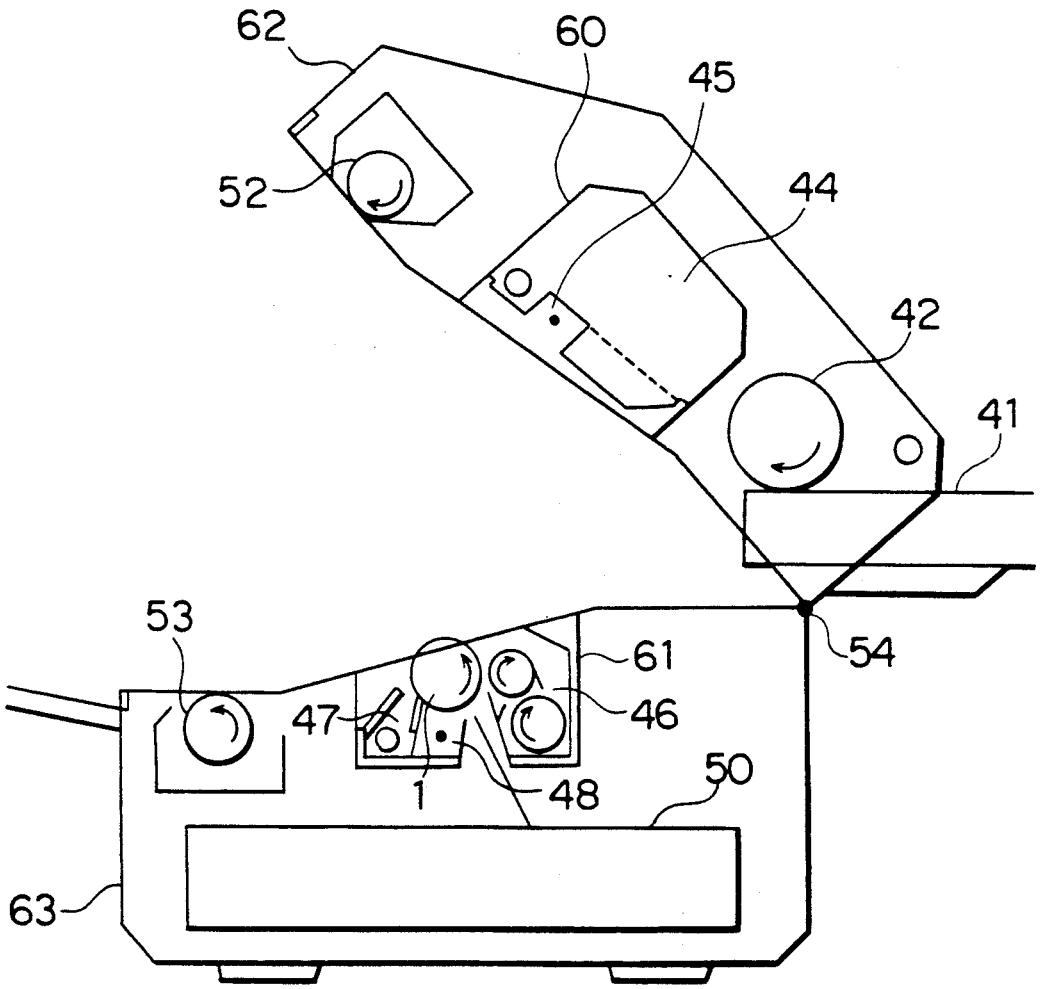
FIG. 5 is a drawing of the embodiment shown in FIG. 4 with the upper frame open.

FIGS. 4 and 5 are schematic views of this embodiment. FIG. 4 shows the status wherein an upper frame 62 is closed against a lower frame 63. When the upper frame 62 is held up in the direction of the arrow A, it is separated from the lower frame at the line D as shown in FIG. 5.

In this embodiment, the separation line between the first unit 61 and the second unit 60 matches the separation line between the upper frame 62 and the lower frame 63. They may not match with each other. When the upper and lower frames are closed as shown in FIG. 4, the image forming drum 1 in the first unit 61 is opposite to the transfer unit in the second unit 60 to form a recording paper feed path including the left and right portions. The recording paper is fed from a paper feed cassette 41 by a paper feed roller 42 and enters the recording paper feed path, which is formed by the opposite portions of the first unit 61 and the second unit 60, via a guide plate which is not shown in the figure. When the recording paper passes between the image forming drum 1 and the transfer unit 45 and discharging bar 65, the toner image is transferred onto the recording paper. After the recording paper passes through the paper feed path formed by the two units, the transferred image is fixed by a developing unit and the recording paper is ejected from the apparatus.

When it is necessary to check the inside of the apparatus due to jammed paper or others, the upper frame 62 can be pivoted upward as shown in FIG. 5. The second unit 60 mounted to the upper frame 62 is pivoted upward simultaneously, and the recording paper feed path, which is formed by the second unit 60 and the opposite first unit 61 mounted to the lower frame 63, is revealed fully. By doing this, the maintenance and inspection can be performed extremely easily.

A protective cover, which is not shown in the figure, is provided for the image forming drum which is revealed when the upper frame 62 is pivoted upward. The protective cover may be handled manually or by the well-known technique using a pin or spring that the protective cover is opened by holding up the upper frame 62 up to a predetermined position or the protective cover is released by lowering the upper frame 62.

In this embodiment, the first unit 61 and the second unit 60 can be installed in or removed from the apparatus by the well-known structural technique, providing easy maintenance and inspection. It is desirable to install or remove the units toward a developing unit to be released. Since the second unit 60 is separable from the first unit 61, when toner is exhausted, it can be easily exchanged with a new one.

In this embodiment, the upper fixing roller 52 is secured to the upper frame 62 and the lower fixing roller 53 is secured to the lower frame 63. When the upper frame 62 is pivoted upward, the upper fixing roller 52 is also pivoted upward, and jammed paper in the fixing unit can be easily removed. In this configuration, jammed paper in the fixing unit can be easily removed, and the first and second units can be installed or removed in the opening direction of the upper frame. In this case, the upper fixing roller 52 and the lower fixing roller 53 are revealed. It is desirable to provide a protective cover for the upper fixing roller 52 and the lower fixing roller 53 which are opened or closed when the upper frame is opened or closed.

In the present invention, the upper fixing roller 52 is opened simultaneously with the upper frame 62 which is opened. However, the upper fixing roller 52 may be left on the lower frame 63 side. In this case, it is desirable to release the fixing rollers from contact when the upper frame 62 is opened. By doing this, the interference between the second unit 60 and the upper fixing roller 52 is minimized, and the second unit 60 can be installed or removed more easily.

In this embodiment, as mentioned above, the second unit containing the toner box and transfer means is installed in the upper frame, and the first unit containing the image forming drum, charging means, developing unit, and cleaner is installed in the lower frame. Since the upper frame can rotate round the horizontal shaft which joins and supports the upper and lower frames for opening or closing, when the upper frame is held up by rotation, the second unit is also pivoted upward, and the space formed by the transfer means and the opposite image forming drum and the recording paper feed path formed before and behind the space are revealed fully.

Therefore, the paper feed path can be easily cleaned or jammed paper can be easily removed.

In the configuration such that the first and second units can be exchanged, they can be easily exchanged when a fault occurs, providing improved maintainability.

Next, an embodiment that protective covers, which can be opened or closed, are installed at the outlet and inlet of the recording paper feed path of the cartridge to prevent dust and outside light from entry will be described hereunder.

In this embodiment, the recording paper feed path, transfer means, and toner box are installed above the image forming drum, and the charging means, developing unit, and cleaner are installed around the image forming drum under the paper feed path. The image forming drum and other components are integrated to a process cartridge which can be installed in or removed from the apparatus. Protective covers, which can be opened or closed, are installed at the inlet and outlet of the recording paper feed path of the process cartridge.

In this embodiment, the protective covers may be structured so that when the process cartridge is installed in the image forming apparatus, they are automatically opened or when the process cartridge is removed from the image forming apparatus, they are automatically closed.

The protective covers, which are open because the process cartridge is installed in the image forming apparatus, may be a part of the recording paper feed path.

Next, this embodiment will be described hereunder with reference to the drawings.

Figure 6:
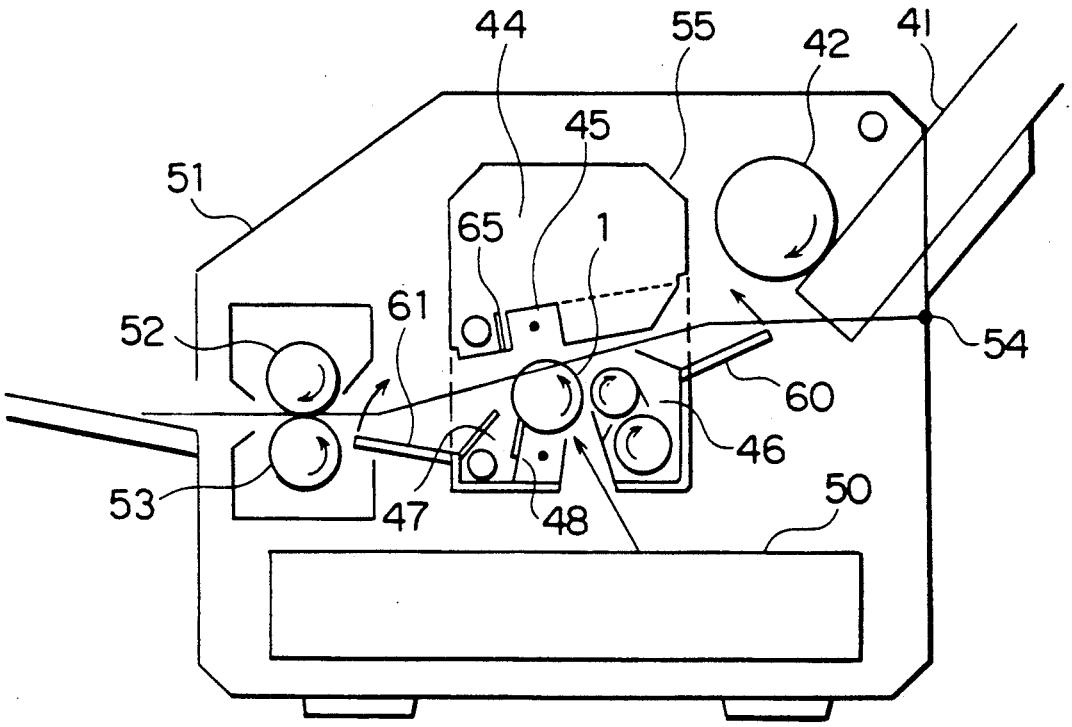
FIGS. 6 and 7 are schematic views of a protective cover which is open or closed.

FIG. 6 is a schematic view of this embodiment. Portions common to FIG. 1 will not be described. A difference between FIG. 1 and FIG. 6 is that a protective cover 60 is installed at the inlet of the recording paper feed path of a cartridge 55 and a protective cover 61 is installed at the outlet, and the protective covers can rotate in the directions of the arrows indicated at the tops thereof.

The protective covers shown in FIG. 6 are open. When the cartridge 55 is removed from the image forming apparatus, the protective covers 60 and 61 are closed to prevent dust and outside light from entry.

Figure 7:
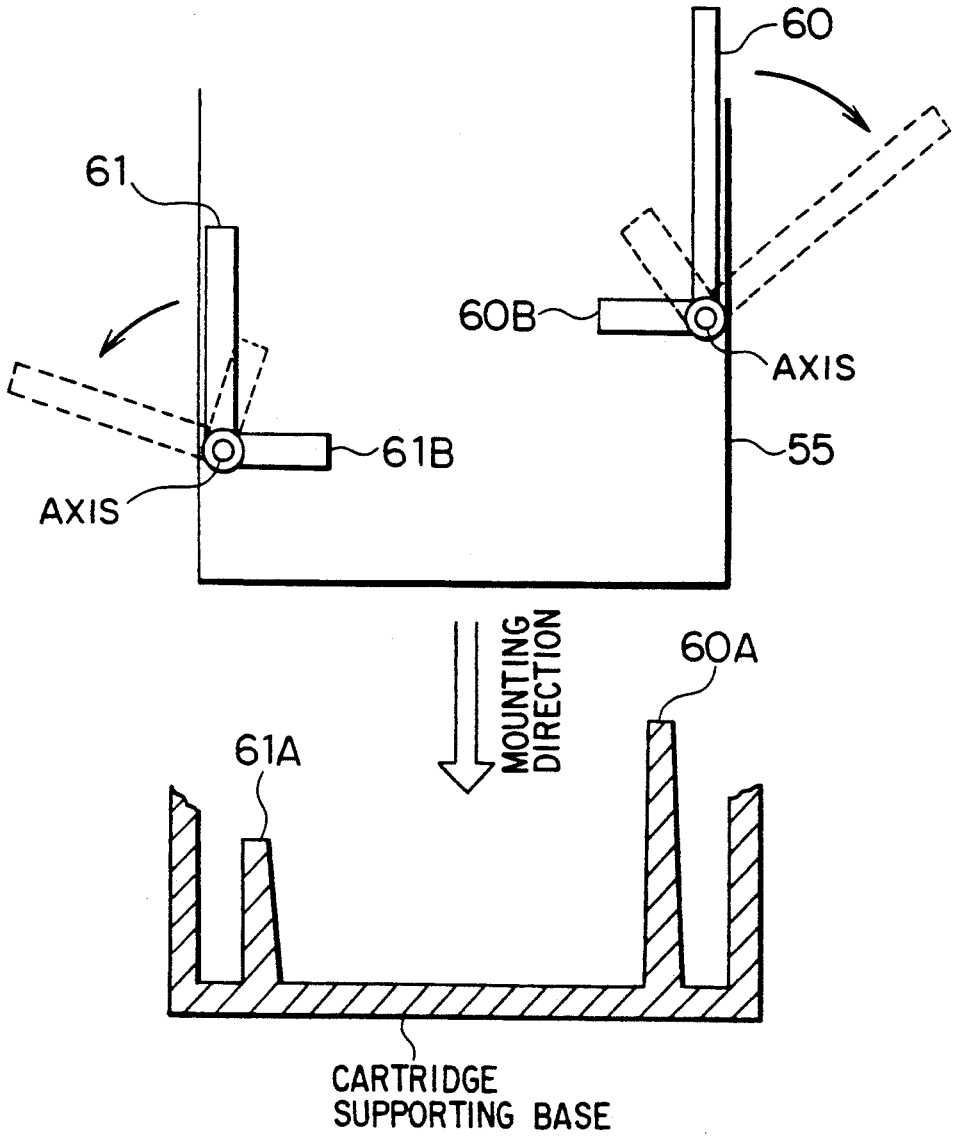
Figure 8:
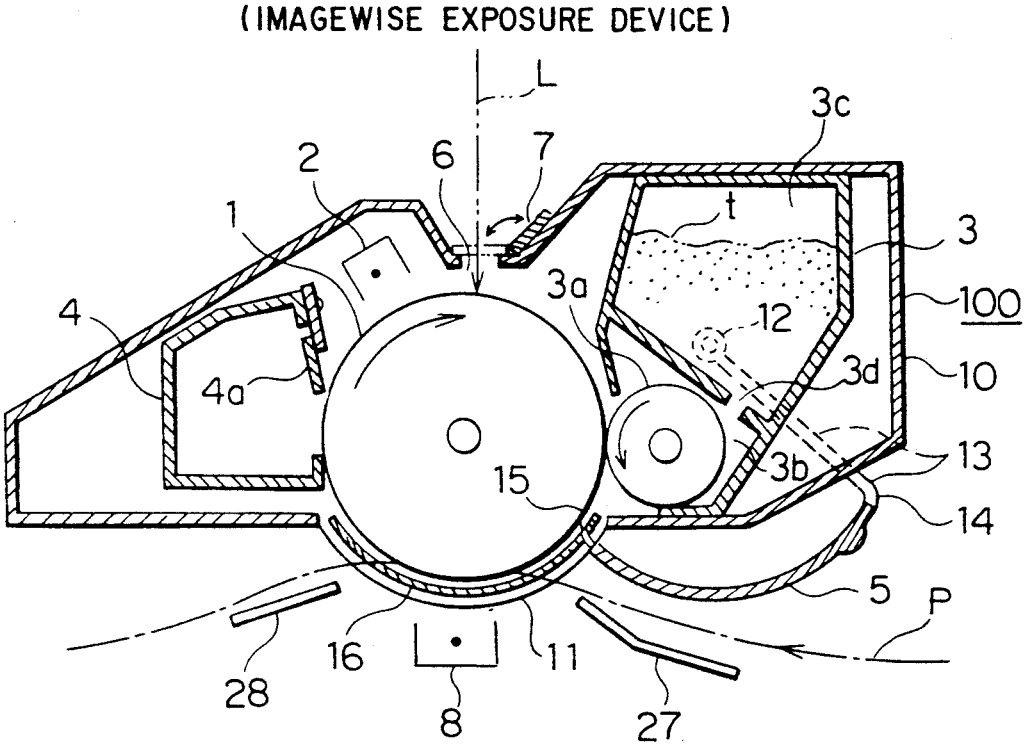
FIG. 8 (PRIOR ART)
FIG. 8 is a schematic view of a conventional cartridge.
Figure 9:
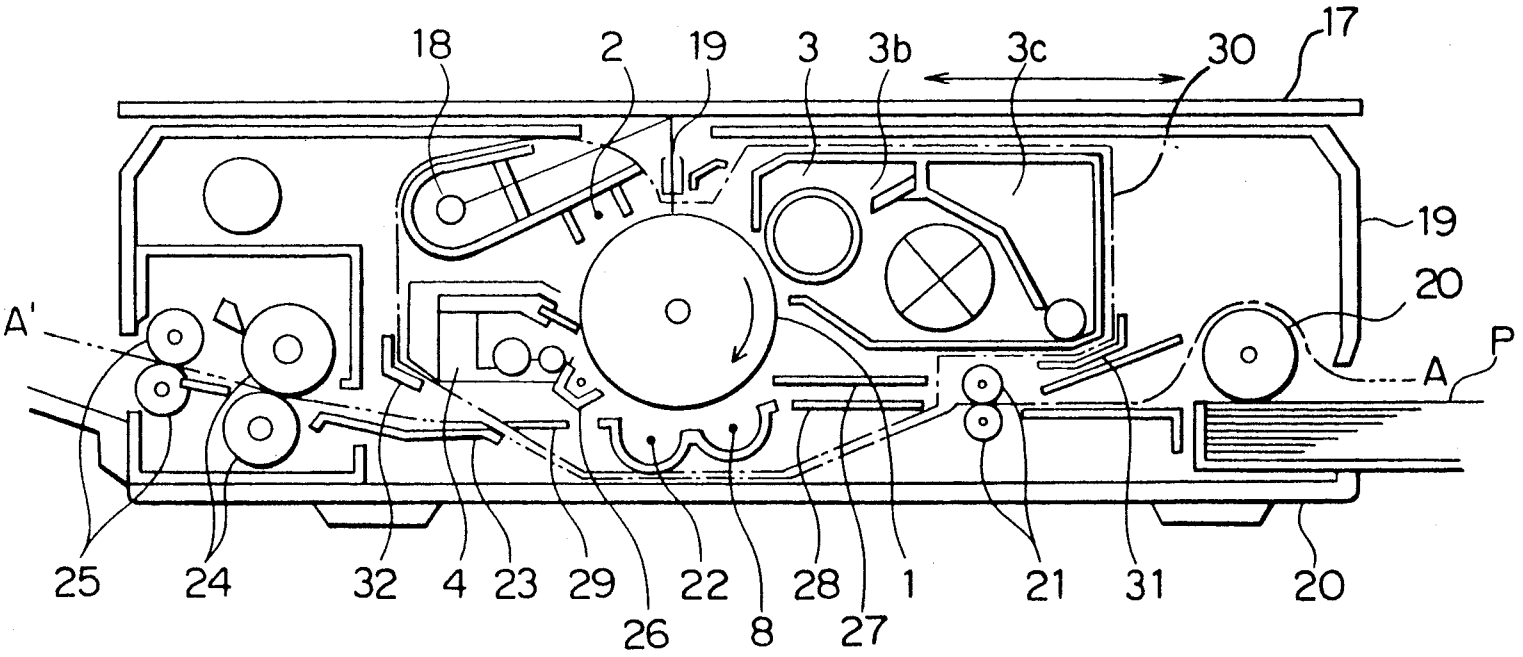
FIG. 9 (PRIOR ART)
FIG. 9 is a drawing showing another example of a conventional cartridge which is mounted to a copier.

When the cartridge 55 is installed or removed, the protective covers are opened or closed, for example, by the mechanism shown in FIG. 7. FIG. 7 shows how to install the cartridge on the cartridge support table of the lower frame.

The cartridge 55 is installed and secured to this support table. The cartridge support table has protrusions 60A and 61A at the ends thereof, and the protrusions press up protrusions 60B and 61B which are provided at the ends of the protective covers 60 and 61 of the cartridge when the cartridge is installed. The protrusions 60B and 61B rotate round the rotation shafts to open the protective covers 60 and 61 in synchronization. When the cartridge is removed, the protective covers 60 and 61 of the cartridge are closed by reverse action.

In this embodiment, the protective cover 60, which is open, serves as a guide plate for recording paper feed.

In this embodiment, opening or closing of the protective covers of the cartridge correspond to installation or removal of the cartridge. Another mechanism may be used.

For example, the protective covers of the cartridge may be opened or closed in correspondence with opening or closing of the upper cover 51 instead of installation or removal of the cartridge. By doing this, the protective covers are open only when the upper cover is closed, providing favorable results.

The protective cover in FIG. 6 is structured so as to open one way from top to bottom. However, the protective cover may be divided into two parts so that the upper and lower covers can be opened upward and downward.

Furthermore, the toner box and transfer unit of the cartridge may be installed in or removed from the cartridge in an integrated state to exchange the toner box with a new one as a disposable one.

In the image forming apparatus of the present invention, as mentioned above, since protective covers, which can be opened or closed, are installed at the inlet and outlet of the recording paper feed path of the process cartridge, recording paper can be fed with the protective covers open when the cartridge is installed. When the cartridge is removed, dust and direct outside light can be prevented from entry into the image forming drum by closing the protective covers.

When the protective covers are structured so that they are automatically opened or closed when the cartridge is installed or removed, it can be prevented to leave the protective covers open or closed, and the function can be fulfilled.

In the configuration such that the protective covers serve as a guide plate for recording paper feed when the cartridge is installed, the main unit of the image forming apparatus can be simplified in structure.

In the configuration such that the toner box and transfer means can be installed in or removed from the cartridge in an integrated state, when toner is exhausted, the toner box can be exchanged conveniently as a disposable one.

What is claimed is:

1. An apparatus for forming an image comprising:

a first group comprising, a rotatable image carrier on which an electrostatic latent image is formed; a charger for charging said image carrier; and a developer for developing said latent image into a toner image; and a second group comprising, a transferer for transferring said toner image to a recording sheet; a sheet passage for passing said recording sheet through said transferer, and a toner container for storing toner therein, said second group being disposed above said first four in a cartridge, said cartridge comprising an upper housing in which said transferer and said toner container are detachable installed, and a lower housing in which said first group is installed, and wherein said upper housing is mounted on said lower housing and adapted to pivot between an open position and a closed position.

2. The apparatus of claim 1, wherein there is provided the sheet passage between the upper housing and lower housing so that, when the upper housing is pivoted to the open position, the sheet passage is exposed so as to become accessible.

3. An apparatus for forming an image comprising:

a first group comprising, a rotatable image carrier on which an electrostatic latent image is formed; a charger for charging said image carrier; and a developer for developing said latent image into a toner image; and a second group comprising, a transferer for transferring said toner image to a recording sheet; a sheet passage for passing said recording sheet through said transferer, and a toner container for storing toner therein, said apparatus further comprising an upper casing and a lower casing, said upper casing being mounted on said lower casing and being adapted to pivot between an open position and a closed position, an upper unit in which said transferer and said toner container are installed being mounted in said upper casing, a lower unit, in which said first group is installed, being mounted in said lower casing.

4. The apparatus of claim 3, wherein there is provided the sheet passage between the upper unit and the lower unit, and wherein, when the upper casing is pivoted to the open position, the sheet passage is exposed so as to become accessible.

* * * * *